US008916810B2

(12) United States Patent
Geswender et al.

(10) Patent No.: US 8,916,810 B2
(45) Date of Patent: Dec. 23, 2014

(54) STEERABLE SPIN-STABILIZED PROJECTILE

(75) Inventors: Christopher E. Geswender, Green Valley, AZ (US); Richard Dryer, Oro Valley, AZ (US); Paul Vesty, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 542 days.

(21) Appl. No.: 13/075,277

(22) Filed: Mar. 30, 2011

(65) Prior Publication Data

US 2012/0248239 A1 Oct. 4, 2012

(51) Int. Cl.

| | |
|---|---|
| ***F42B 10/06*** | (2006.01) |
| ***F42B 10/64*** | (2006.01) |
| ***F42B 10/26*** | (2006.01) |

(52) U.S. Cl.

CPC ..... *F42B 10/64* (2013.01); *F42B 10/26* (2013.01)

USPC ..... 244/3.23

(58) Field of Classification Search

USPC ..... 244/3.15, 3.21, 3.23, 3.24, 3.26, 3.28, 244/3.29, 3.1

See application file for complete search history.

(56) References Cited

U.S. PATENT DOCUMENTS

| | | | | |
|---|---|---|---|---|
| 3,585,935 | A * | 6/1971 | Birkigt | 102/240 |
| 4,512,537 | A * | 4/1985 | Sebestyen et al. | 244/3.21 |
| 4,964,593 | A | 10/1990 | Kranz | |
| 5,114,095 | A * | 5/1992 | Schroppel et al. | 244/3.28 |
| 5,235,930 | A | 8/1993 | Pendleton | |
| 6,073,880 | A | 6/2000 | Voigt et al. | |
| 6,135,387 | A * | 10/2000 | Seidel et al. | 244/3.15 |
| 6,360,987 | B1 | 3/2002 | Sallaee et al. | |
| 7,004,425 | B2 * | 2/2006 | Okada et al. | 244/3.29 |
| 7,267,298 | B2 * | 9/2007 | Leininger | 244/3.24 |
| 7,354,017 | B2 | 4/2008 | Morris et al. | |
| 7,412,930 | B2 | 8/2008 | Smith et al. | |
| 2002/0117580 | A1 * | 8/2002 | Rupert et al. | 244/3.24 |
| 2008/0223977 | A1 | 9/2008 | Dryer | |
| 2010/0282895 | A1 | 11/2010 | Geswender | |
| 2010/0320330 | A1 | 12/2010 | McMickell et al. | |
| 2012/0175458 | A1 * | 7/2012 | Geswender | 244/3.24 |
| 2012/0175459 | A1 * | 7/2012 | Geswender et al. | 244/3.24 |

OTHER PUBLICATIONS

U.S. Appl. No. 12/843,921, filed Jul. 27, 2010.

* cited by examiner

*Primary Examiner* — Valentina Xavier

(74) *Attorney, Agent, or Firm* — Renner, Otto, Boisselle & Sklar, LLP

(57) ABSTRACT

A spin-stabilized projectile has a collar around the middle of its spun fuselage, longitudinally spanning a center of mass of the projectile. The collar includes lift-producing aerodynamic surfaces. Positioning the collar relative to the spinning fuselage produces a direct lift force on the projectile that may be used to steer the projectile. Since the projectile is constantly spinning, the positioning may be accomplished by a brake, such as a magnetic brake or a fiction brake, that allows the collar to be positioned substantially fixed relative to inertial space, with the collar not rotating with the fuselage about a longitudinal axis of the projectile. Since the lift force is applied close to the center of mass of the projectile, the steering occurs with no substantial change in the angle of attack of the projectile.

20 Claims, 3 Drawing Sheets

STEERABLE SPIN-STABILIZED PROJECTILE

BACKGROUND OF THE INVENTION

1. Field of the Invention

The present invention is in the field of projectiles.

2. Description of the Related Art

The effectiveness of a projectile may be limited by a variety of constraints. Two such constraints are range and accuracy. For instance, an artillery-fired projectile may have a limited range relating to a maximum muzzle velocity for a given combination of projectile, barrel, and propellant. Frequently, targets beyond this limited range cannot be effectively reached. Additionally, an artillery-fired projectile may have a fixed trajectory upon firing. As a consequence, an unguided projectile that is not accurately aligned upon firing may miss its intended target. Other factors can reduce the accuracy of the unguided projectile, such as atmospheric conditions, variations in the aerodynamic properties of a given projectile, and/or the like.

Limited range and accuracy may have a number of effects in combat situations. Limited range may require engaging the enemy at a close proximity. Poor accuracy may require engaging the enemy for an extended duration with multiple rounds. In these scenarios, the parameters of the artillery-fired projectile may increase the cost of operations, yet provide a weapon system having a low effectiveness. This may adversely affect the logistics burden of the system and the lives of combatants who must experience longer times to service combat targets.

Existing systems for modifying the trajectory of a projectile include systems having actuatable control surfaces configured to steer the projectile. While these systems may serve to guide the projectile, such systems may also add substantial complexity and weight to the projectile, and the inherent drag of the aerodynamic controls may reduce the range of the projectile.

SUMMARY OF THE INVENTION

According to an aspect of an invention, a spin-stabilized projectile has lift-producing aerodynamic surfaces that longitudinally span a canter of mass of the projectile.

According to a further aspect of the invention, a projectile includes: a spin-stabilized fuselage; and a collar having lift-producing aerodynamic surfaces. The collar is positionable relative to the spin-stabilized fuselage by relative rotation about a longitudinal axis of the projectile. The collar longitudinally spans a center of mass of the missile.

According to a still further aspect of the invention, a method of maneuvering a projectile includes: spinning a fuselage of the projectile to stabilize the projectile; and steering the projectile by positioning a collar of the projectile relative to the fuselage, thereby causing lift-producing aerodynamic surfaces of the collar to produce a direct net steering force on the projectile. The collar longitudinally spans a center of mass of the projectile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
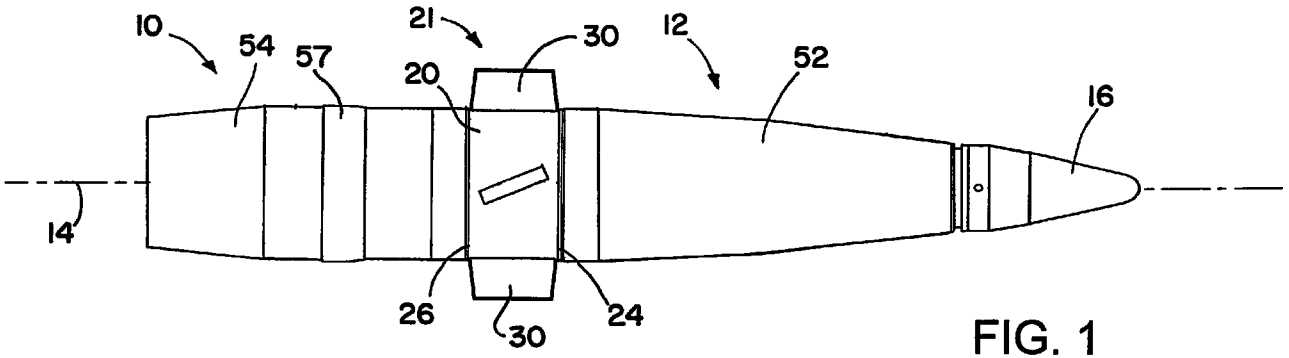
FIG. 1 is a side view of a projectile according to an embodiment of the present invention.
Figure 2:
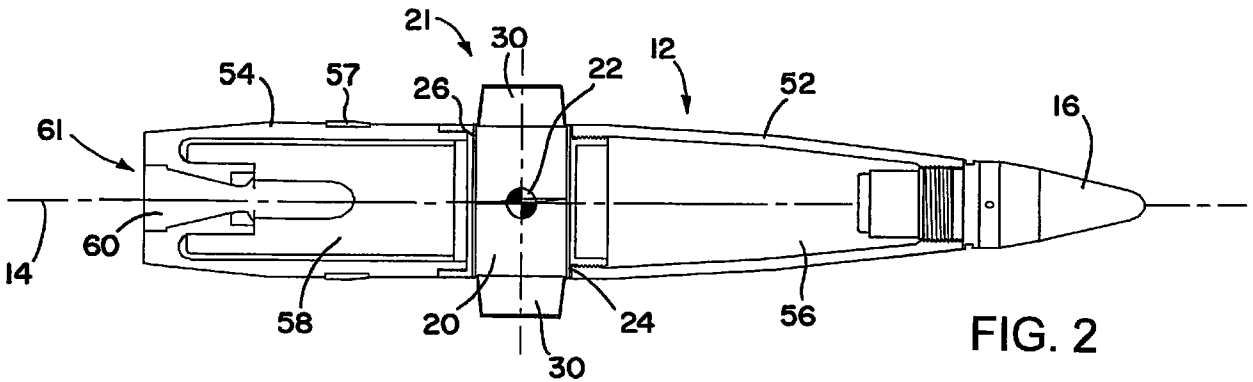
FIG. 2 is a cross-sectional view of the projectile of FIG. 1.
Figure 3:
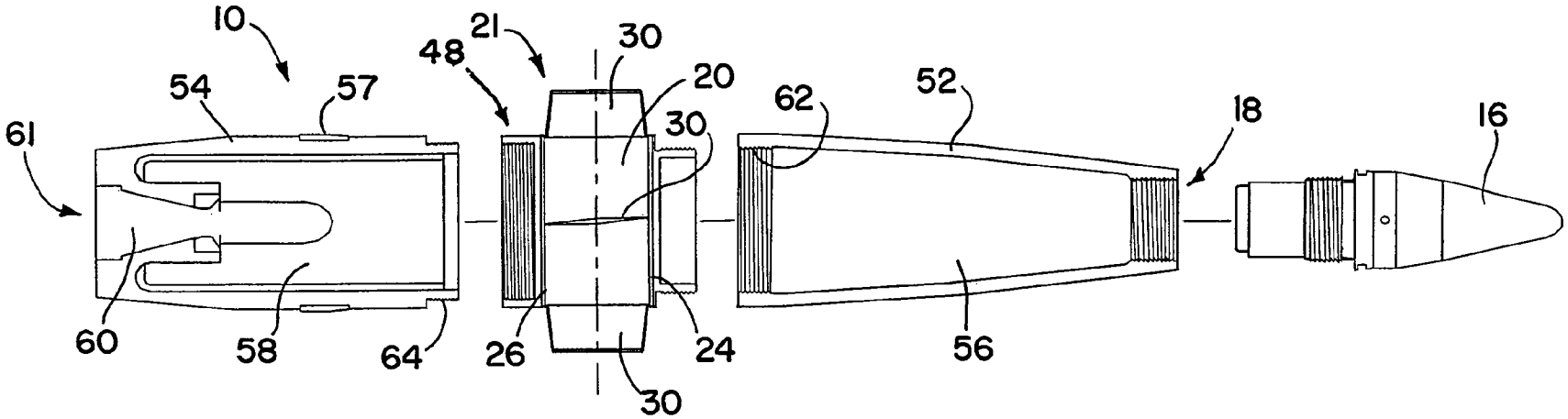
FIG. 3 is an exploded view of the projectile of FIG. 1.

A spin-stabilized projectile has a collar around the middle of its spun fuselage, longitudinally spanning a center of mass of the projectile. The collar includes lift-producing aerodynamic surfaces. Positioning the collar relative to the spinning fuselage produces a direct lift force on the projectile that may be used to steer the projectile. Since the projectile is constantly spinning, the positioning may be accomplished by a brake, such as a magnetic brake or a fiction brake, that allows the collar to be positioned substantially fixed relative to inertial space, with the collar not rotating with the fuselage about a longitudinal axis of the projectile. Since the lift force is applied close to the center of mass of the projectile, the steering occurs with no substantial change in the angle of attack of the projectile.

FIGS. 1-4 show a spin-stabilized projectile 10 that has a spinning (rolling) fuselage 12. The spinning fuselage 12 is spun (rolled) about a longitudinal axis 14 of the projectile 10, in order to stabilize the course of the projectile 10 during flight. The spinning may be imparted during launch of the projectile 10, such as by use of rifling in a launch tube, and/or it may be imparted by torque-producing canted fins (not shown), which may be deployed during flight of the projectile 10. A fuze kit 16 is coupled to a forward end of the fuselage 12, in a fuze well 18. The fuze kit 16 may be used to detonate an explosive that is located inside the fuselage 12. The fuze kit 16 may provide other functions, such as providing guidance control for the projectile 10, controlling the steering of the projectile 10 toward a target or other intended destination.

The aerodynamic forces for steering the projectile 10 are provided by a roll collar 20 that is part of a control activation system (CAS) 21. The roll collar 20 longitudinally spans a center of mass 22 of the projectile 10. The center of mass 22 is on the longitudinal axis 14 of the projectile 10. In longitudinally spanning the center of mass 22, a front edge 24 of the collar 20 is longitudinally forward of the center of mass 22, and a back edge 26 of the collar is longitudinally aft of the center of mass 22. The roll collar 20 has a series of lift-producing aerodynamic surfaces 30, such as wings, on its perimeter. The lift-producing aerodynamic surfaces 30 may be an even number of surfaces, for instance consisting of two, four, or six lift-producing surfaces. The surfaces 30 may be even distributed about the outer surface (perimeter) of the collar 20. More broadly, pairs of the surfaces 30 may be diametrically opposed to each other.

The collar 20 is positionable in the inertial frame, relative to the projectile, to produce a resultant force on the projectile 10, in order to provide steering to the projectile 10. As described in greater detail below, the projectile 10 includes a mechanism 40 for positioning the collar 20 about the longitudinal axis 14. This allows the collar 20 to remain in a desired circumferential orientation about the longitudinal axis 14, even as the fuselage 12 spins about the longitudinal axis 14.

The collar 20 is mounted on bearings 42 and 44, such as ball bearings, to allow the collar 20 to rotate freely relative to a fixed inner section 48 that is fixedly attached to the fuselage 12. The fixed section may be threaded onto or otherwise secured to a forward fuselage portion 52 and an aft fuselage portion 54. The forward fuselage portion 52 houses a payload 56, such as a suitable explosive. The aft fuselage portion 54 has an obturator 57 on it, and houses a propellant 58 for propelling the projectile 10. The propellant 58 is ignited by an igniter 60 at the back end of the projectile 10. Once ignited, the propellant 58 produces pressurized gasses that are ejected from the projectile 10 through a nozzle 61, providing forward thrust. The aft fuselage section 54 might also be more explosive payload in place of a propulsive capability, or the projectile could be modular in design so that the aft section can be selected by the user to be propulsive or explosive, thereby providing the user the flexibility of selecting maximum range or maximum lethality for the munition.

In the illustrated embodiment the forward fuselage portion 52 has internal threads 62, and the aft fuselage portion 54 has external threads 64. The threads 62 and 64 engage the inner section 48 of the control activation system 21. The inner section 48 and the collar 20 may be parts of a single assembly, such as the CAS 21, with the bearings 42 and 44 allowing rotation of the collar 20 relative to the inner section 48.

A representative mechanism 40 for positioning the collar 20 may be a brake that provides some engagement between the collar 20 and the fuselage 12. The collar 20 may configured such that the surfaces 30 naturally provide a counter-rotation to the collar 20, a rotation that is about the longitudinal axis 14 in a direction opposite from the direction of spin of the fuselage 12. The combination of the natural counter-rotation of the collar 20 and the selective partial coupling of the collar 20 to the fuselage 12 may be used to keep the collar 20 stable relative to an external frame of reference, and/or to selectively position the collar 20 as desired about the longitudinal axis 14.

The mechanism 40 may be a friction brake or a magnetic brake that can partially couple the movement of the collar 20 and the fuselage 12. An example of a friction brake is shown in U.S. Pat. No. 7,412,930.

Figure 4:
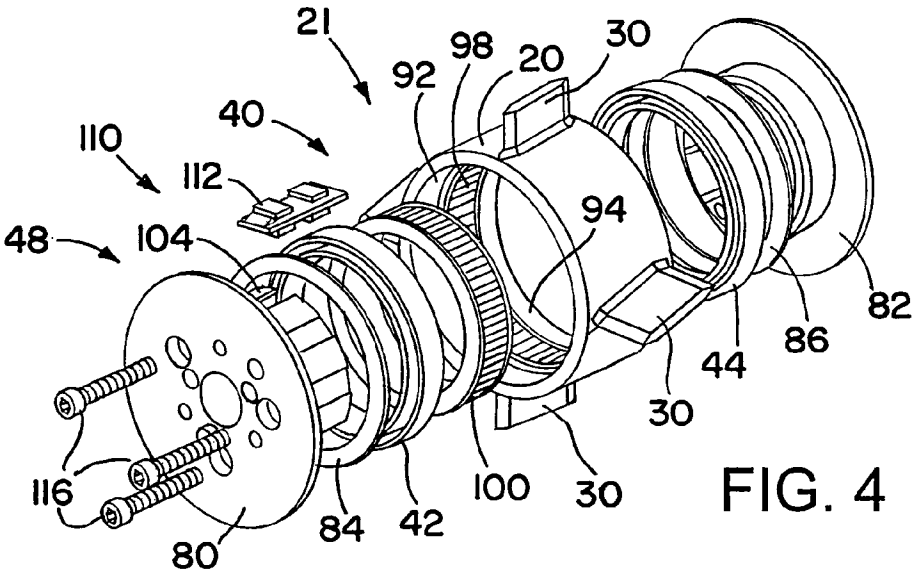
FIG. 4 is an exploded view of the control activation system of the projectile of FIG. 1.

FIG. 4 shows further details of the control activation system 21, specifically the inner section 48, and its relation to the bearings 42 and 44 and the collar 20. The example shown in FIG. 4 is a magnetic brake. The inner section 48 includes a main housing 80 and an aft closure 82, on opposite ends. The housing 80 and the closure 82 may be configured to engage the fuselage portions 52 and 54 (FIGS. 1-3), such as with threaded extensions (not shown in FIG. 4).

The inner section includes a pair of Belleville washers 84 and 86. The Belleville washer 84 is between the housing 80 and the bearing 42, and the Belleville washer 86 is between the aft closure 82 and the bearing 44. The Belleville washers aid in maintaining proper positioning of the bearings 42 and 44 relative to the collar 20. The bearings 42 and 44 are located on indentations 92 and 94 on an inner surface of the collar 20. The indentations 92 and 94 are opposite sides of a series of magnets 98 along the inner surface of the collar 20.

An armature 100 is radially inward of the magnets 98. The armature 100 is mounted on a circular ledge 104 of the main housing 80. This allows the armature 100 to move along with the fuselage 12, rotating about the longitudinal axis 14 as the fuselage 12 spins. A control system 110 may be used to provide current to the armature 100, as needed, to provide the desired resistance against movement of the collar 20 (including the magnets 98) relative to the fuselage 12 (including the armature 100). The control system 110 is represented in FIG. 4 as a MOSFET printed circuit board set 112, one of three such sets. The control system 110 may be connected in a wired connection or a wireless connection with a guidance control in the fuze kit 16 (FIG. 1). The control system 110 may take any of a wide variety of forms.

The assembly of parts shown in FIG. 4 is held together by a series of bolts 116 that extend from the housing 80 to the closure 82. There may be a central opening in the assembly that allows passage of other components of the projectile 10 (FIG. 1), such as wires for communication of signals.

Figure 5:
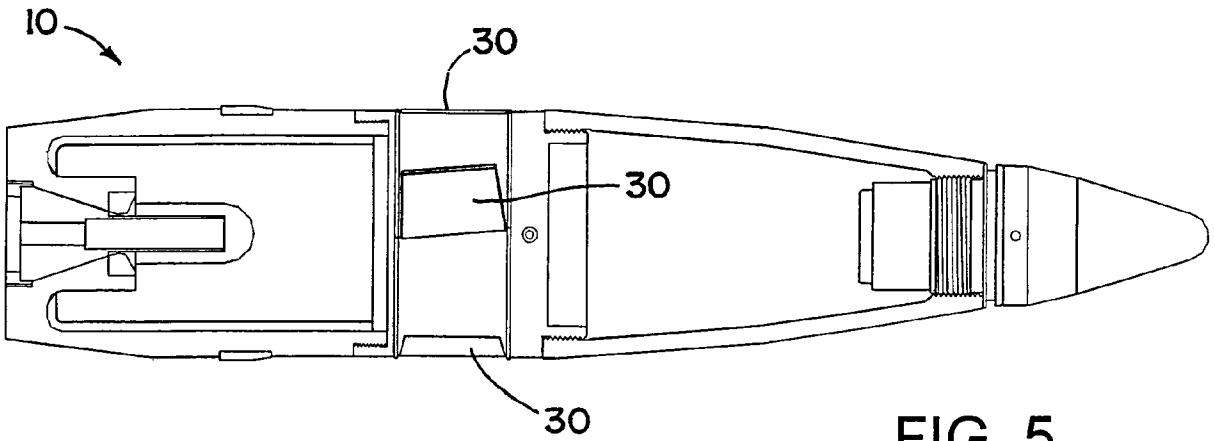
FIG. 5 is a view of the projectile of FIG. 1, showing the lift-producing surfaces in a stowed condition.

Turning now to FIG. 5, the lift-producing surfaces 30 are deployable, able to be deployed from an initial collapsed/stowed configuration shown in FIG. 5. In the collapsed/stowed configuration the surfaces 30 are against the body of the projectile 10. The surfaces 30 may have some flexibility when in the collapse/stowed configuration, and may automatically deploy to the deployed configuration (FIGS. 1 and 2) during flight. The deployment may come shortly after the projectile 10 exits a launch tube or other launcher.

Figure 6:
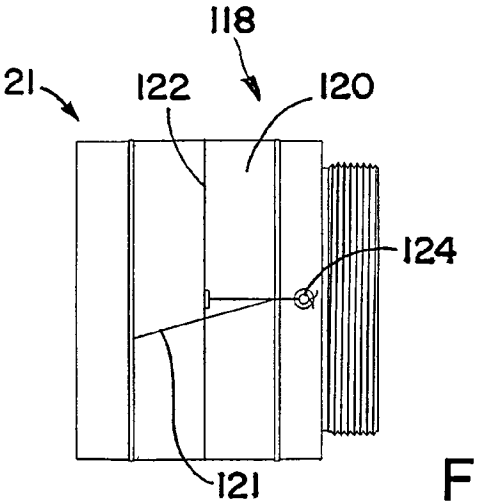
FIG. 6 is a side view of the control activation system of the projectile of FIG. 1, showing components of a constraint system for keeping the lift-producing surfaces in a stowed condition.

In the stowed configuration the lift-producing surfaces 30 may be biased toward deployment unless constrained. An example of a suitable constraint and deployment system 118 is illustrated in FIG. 6. A sheet metal cover 120 contains and protects the lift-producing surfaces (FIG. 5) in the stowed configuration. The cover 120 is slit along a cut line 121, and is held in place with a retaining wire 122 that is connected to a pyrotechnic device 124. Firing the pyrotechnic device 124 causes the retaining wire 122 to be loosened and discarded from the projectile 10. This in turn lets the cover 120 separate from the projectile 10, allowing the lift-producing surfaces 30 to deploy. Further details regarding such a deployment system may be found in co-owned U.S. Patent Pub. 2010/0282895, the description and figures of which are incorporated by reference.

The projectile 10 and the collar 20 may rotate about the projectile axis 14 at any of a variety of suitable frequencies. For example the fuselage 12 may spin at a frequency of about 200 Hz. The collar 20 may be configured to counter-rotate at a frequency of about 20 Hz, in the absence of any braking force. These numbers are only example values.

Figure 7:
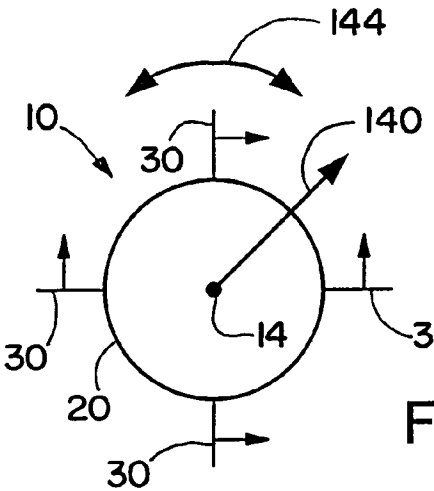
FIG. 7 is an end schematic view illustrating lift forces produced by the lift-producing surfaces of the projectile of FIG. 1.

FIG. 7 illustrates the forces on the projectile 10 from the lift-producing surfaces 30. Diametrically-opposed surfaces 30 produce forces in the same direction (up and to the right in the illustrated embodiment), but of different magnitudes. Together the surfaces 30 generate a resultant force 140 on the projectile 10, and a resultant torque 144 on the collar 20. The resultant force 140 is used to steer the projectile 10, and the resultant torque is used to provide the counter-rotation of the collar 20 (in the absence of a braking force).

The resultant force 140 is applied at or near the center of mass of the projectile 10. The longitudinal location of the resultant force 140 (the longitudinal location of the center of the lift forces produced by the surfaces 30) may be within 1 cm (0.4 inches) of the center of mass, or more narrowly within 0.63 cm (0.25 inches) of the center of gravity. This is for a projectile having an overall of 76 cm (30 inches), for example.

By acting at (or very close to) the center of gravity the force 140 provides a steering lift to the projectile 10, without changing the angle of attack of the projectile 10. This is in contrast to steering that relies on precession to induce steering forces on a projectile. Precession requires a change in orientation (angle of attack), which results in drag that decreases overall range. The projectile 10, which is steered without substantial change in angle of attack, does not suffer the same drag as precession-steered projectiles. Therefore the projectile 10 has a longer range than other steered spin-stabilized projectiles. The projectile 10 combines the accuracy and steering authority of fin-stabilized projectiles with the simplicity and low cost of prior spin-stabilized projectiles that utilize gyroscopic (precession-based) steering.

In the embodiment described above the lift-producing aerodynamic surfaces 30 may be fixed in their positions on the collar 20. That is, their angles of attack are fixed, with the collar being rotated as a unit. An alternative arrangement is have the lift-producing surfaces shifting in angle of attack, for example by use of a swash plate to alter the angle of attack of cyclically as the fuselage 12 spins. The variable angle-of-attack lift-producing surfaces would still be on a collar, which could be selectively rotated to position the lift-producing surfaces. The swash plate system may be similar in some respects to the systems disclosed in co-owned U.S. patent application Ser. No. 13/005,175, filed Jan. 12, 2011, titled "Guidance Control for Spinning or Rolling Projectile," the description and figures of which are incorporated by reference.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a spin-stabilized fuselage; and a collar having lift-producing aerodynamic surfaces;

wherein the collar is positionable relative to the spin-stabilized fuselage by relative rotation about a longitudinal axis of the projectile; and wherein the collar longitudinally spans a center of mass of the projectile.

2. The projectile of claim 1, wherein the aerodynamic surfaces have a fixed angle of attack.

3. The projectile of claim 1, wherein the aerodynamic surfaces have a variable angle of attack.

4. The projectile of claim 1, further comprising a brake that positions the collar relative to the spin-stabilized fuselage.

5. The projectile of claim 4, wherein the brake is a magnetic brake.

6. The projectile of claim 5, wherein the collar includes a series of magnets that interact with an armature connected to the fuselage.

7. The projectile of claim 4, wherein the brake is a friction brake.

8. The projectile of claim 4, wherein, during flight and in the absence of braking by the brake, the lift-producing surfaces provide a torque that rotates the collar.

9. The projectile of claim 8, wherein the torque rotates the collar in an opposite direction from spin of the fuselage.

10. The projectile of claim 1, wherein the lift-producing aerodynamic surfaces are deployable from a stowed condition.

11. The projectile of claim 1, wherein a center of lift of the lift-producing surfaces is longitudinally within 1 cm (0.4 inches) of the center of mass.

12. The projectile of claim 1, further comprising a pair of bearings that allow the collar to rotate relative to the fuselage.

13. A method of maneuvering a projectile, the method comprising:

spinning a fuselage of the projectile to stabilize the projectile; and steering the projectile by positioning a collar of the projectile relative to the fuselage, thereby causing lift-producing aerodynamic surfaces of the collar to produce a direct net steering force on the projectile;

wherein the collar longitudinally spans a center of mass of the projectile.

14. The method of claim 13, wherein the steering occurs without substantial change in an angle of attack of the projectile.

15. The method of claim 13, wherein the positioning includes rotating the collar about the longitudinal axis.

16. The method of claim 13, wherein the positioning includes:

counter-rotating the collar, using lift from the lift-producing surfaces, in a direction opposite that of the spinning of the fuselage; and braking the movement of the collar so as to apply a torque on the collar from the fuselage.

17. The method of claim 16, wherein the braking includes magnetic braking.

18. The method of claim 17, wherein the magnetic braking includes interaction between an armature connected to the fuselage and a series of magnets that rotate with the collar.

19. The method of claim 16, wherein the braking includes friction braking.

20. The method of claim 13, wherein a center of lift of the lift-producing surfaces is longitudinally within 1 cm (0.4 inches) of the center of mass.

* * * * *